United States Patent [19]

Windisch

[11] Patent Number: 4,594,924

[45] Date of Patent: Jun. 17, 1986

[54] LIQUID JET CUTTING APPARATUS

[75] Inventor: Franz Windisch, Kapfenberg, Austria

[73] Assignee: Vereinigte Edelstahlwerke Aktiengesellschaft, Vienna, Austria

[21] Appl. No.: 723,564

[22] Filed: Apr. 15, 1985

[30] Foreign Application Priority Data

Apr. 25, 1984 [AT] Austria ..... 1367/84

[51] Int. Cl.[4] ..... B26F 3/00

[52] U.S. Cl. ..... 83/177; 83/53; 239/533.1; 299/17

[58] Field of Search ..... 83/177, 53, DIG. 1; 299/17; 239/533.1, 11

[56] References Cited

U.S. PATENT DOCUMENTS 3,756,106 9/1973 Chadwick et al. ..... 83/177

4,228,956 10/1980 Varner ..... 239/533.1

4,272,017 6/1981 Franz ..... 83/534

*Primary Examiner*—Donald R. Schran

*Attorney, Agent, or Firm*—Werner W. Kleeman

[57] ABSTRACT

The liquid jet cutting apparatus contains a cutter head with a nozzle block and a jet exit opening which communicates with a jet discharge passage. A jet of a pressurized liquid cutting medium is formed in the cutter head and the jet exiting from the jet exit opening passes through the jet discharge passage without contacting the wall thereof. The jet discharge passage communicates through an opening in its wall with a pressure transmission line connecting a gas space formed in the jet discharge passage with a pressure sensor. A transmitter is operatively associated with the pressure sensor and is operated when the pressure in the gas space of the jet discharge passage exceeds or drops below a predetermined pressure threshold value. The transmitter acts upon an actuator or control member of a cut-off device or throughflow regulator which is arranged in the liquid supply line which supplies the pressurized liquid cutting medium to the cutter head.

20 Claims, 1 Drawing Figure

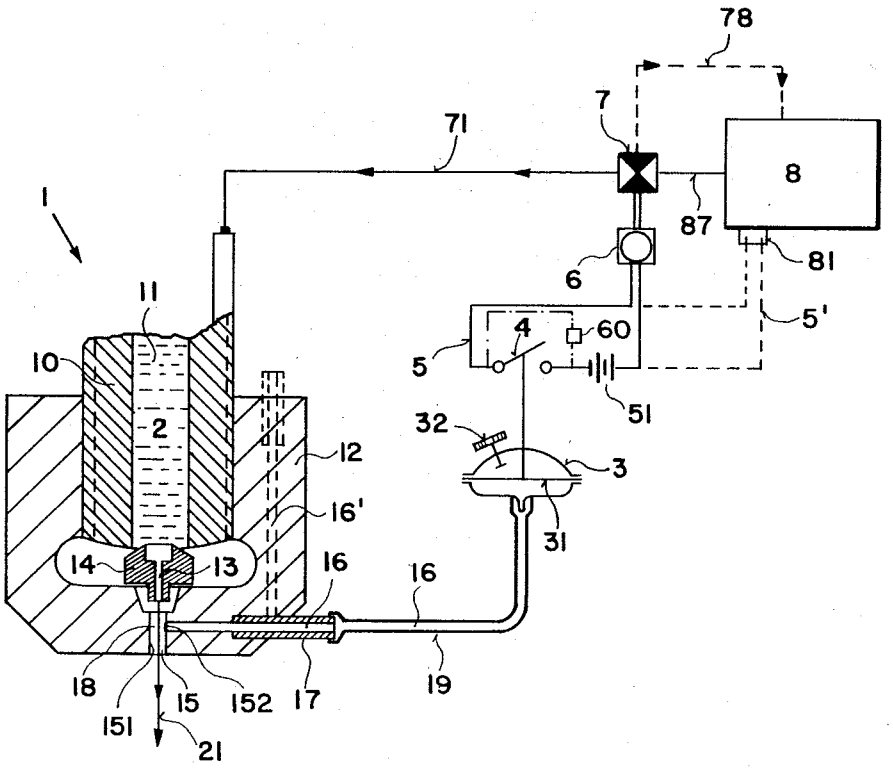
8
81
5'
78
87
7
6
60
51
3
31
4
5
32
71
16
19
12
16'
16
17
152
13
15
21
11
2
151
14
18
10
1

LIQUID JET CUTTING APPARATUS

BACKGROUND OF THE INVENTION

The present invention relates to a new and improved construction of a liquid jet cutting apparatus.

In its more particular aspects the present invention specifically relates to a liquid jet cutting apparatus comprising a high-pressure installation feeding pressurized liquid cutting medium through supply lines to a cutter head. The cutter head contains a housing and a jet exit or outlet opening. Control means are provided for controlling the supply of the pressurized liquid cutting medium to the jet exit opening.

Various designs and constructions of liquid jet cutting apparatuses of the type generally described hereinbefore have been in use for considerable time for cutting the most different types of materials. In order to put their high working speed to optimum use, efforts are made to automate the cutting operation and in such automated cutting operation, for example, the nozzle is guided by means of a program-controlled coordinate guidance system above the material to be cut and which is arranged on a cutting table or support. Such automatic installations are not only of interest for cutting articles having a complicated contour, but particularly also in those cases in which, for example, a large number of similar articles like, for example, smaller annularly shaped articles or the like, must be sequentially cut from a sheet of material.

In such automatically operating installations there is a considerably greater tendency, as compared to manually guided cutting instruments, to interrupt the cutting jet by automatically cutting off the supply of the pressurized liquid cutting medium to the cutting nozzle. This may be required, for example, due to alterations in the jet exit opening as a result of wear, due to partial obstruction of the jet exit opening by micro-particles or the like contained in the pressurized liquid cutting medium, due to changes in the metered addition of polymer compounds or other compounds to the pressurized liquid cutting medium, due to changes in the geometry or other properties of the jet formed by the liquid pressurized cutting medium. All of these variations and changes cause an abrupt deterioration in the quality of the cut contours of the products during the immediate course of the cutting operation.

SUMMARY OF THE INVENTION

Therefore, with the foregoing in mind, it is a primary object of the present invention to provide a new and improved construction of a liquid jet cutting apparatus which is devoid of the aforementioned drawbacks and shortcomings of the prior art constructions heretofore discussed.

A further significant object of the present invention aims at providing a new and improved construction of a liquid jet cutting apparatus in which the production dead time and the production of waste during undesirable changes in the properties of the jet formed by the pressurized liquid cutting medium are maintained at a minimum.

Another important object of the present invention is directed to the provision of a new and improved construction of a liquid jet cutting apparatus which can be operated in a most simple and yet very reliable manner.

Still a significant object of the present invention is directed to a new and improved construction of a liquid jet cutting apparatus in which the operating personnel are automatically alerted to very small and undesirable changes in the properties of the liquid cutting jet formed by the pressurized liquid cutting medium.

A further and more specific object of the present invention is directed to the provision of a new and improved construction of a liquid jet cutting apparatus in which the supply of the pressurized liquid cutting medium to the cutter head is automatically interrupted when very small and undesirable changes occur in the properties of the cutting jet and in which also the operating personnel simultaneously may be alerted to the occurrence of such undesirable changes.

It has been found that the liquid cutting jet exiting from the nozzle causes reduced gas pressure in accordance with the ejector principle in the gas space immediately surrounding the liquid cutting jet formed by the pressurized liquid cutting medium. As a result, the pressure difference thus built up relative to the environmental air pressure sensitively and extremely rapidly responds to even the smallest changes in the structure and/or in the composition of the liquid cutting jet.

Now in order to implement the aforementioned and still further objects of the invention, which will become more readily apparent as the description proceeds, the jet cutting apparatus of the present development is manifested by the features that, a pressure sensor is operatively associated with a transmitter and this pressure sensor can be adjusted to a desired pressure threshold value. This pressure sensor is in flow communication, preferably via a pressure transmission line, with a gas space through which passes or flows the liquid cutting jet of the pressurized liquid cutting medium. Preferably, the cutting jet formed by the pressurized liquid cutting medium does not contact the wall of a jet discharge channel or passage which preferably is arranged immediately downstream of the jet exit or outlet opening and which contains the gas space connected to the aforementioned pressure sensor or reduced pressure sensor.

The pressure sensor or reduced pressure sensor, in turn, is operatively connected to warning means and/or control means containing a control element for blocking or cutting-off the supply of the pressurized liquid cutting medium to the jet exit opening. Such warning means and/or control means are operable whenever there is attained the adjusted or set pressure threshold value or the pressure drops below or exceeds such pressure threshold value, as the case may be.

From the aforementioned gas space which, in most cases, constitutes an air space and which is preferably bounded by the wall of the jet discharge channel or passage, there extends, for example, a conduit or line. In accordance with a most simple embodiment of the inventive liquid jet cutting apparatus this conduct or line can be connected, for example, with a mercury U-tube manometer. For example, in the leg of the U-tube manometer subjected to reduced pressure, there are arranged the poles of a current circuit comprising a current supply and this current circuit is operatively connected with an actuating element or actuator which acts upon the control means which may comprise a cut-off device or a throughflow regulator controlling the supply of the pressurized liquid cutting medium. When the reduced pressure changes due to a change in the properties of the liquid cutting jet formed by the pressurized liquid medium, the mercury in the aforementioned leg of the U-tube manometer, for example, may rise and, when the poles of the current circuit are contacted by the mercury, a current flows which causes the actuation of the liquid cut-off device or throughflow regulator. Instead of or in addition to the control means the liquid jet cutting apparatus may comprise a control element which directly acts upon the high-pressure installation to interrupt the supply of pressurized liquid cutting medium to the cutter head.

Particularly, with respect to a liquid jet cutting apparatus having only limited free space in the region of the jet exit, it is of advantage if the pressure sensor or reduced pressure sensor, which is in flow communication with the gas space situated close to the jet formed by the pressurized liquid cutting medium, is installed within the wall of the jet discharge channel or passage arranged immediately downstream of the jet exit opening. Such pressure sensors may contain, for example, piezo crystals, membranes, strain gauges or other suitable pressure-responsive elements. It is an advantage of such design that practically only flexible electrical conduits extend from the cutter head and they do not interfere with the practical use of the inventive liquid jet cutting apparatus.

In accordance with a further variant of the inventive liquid jet cutting apparatus provision can be advantageously made for the gas space, through which flows the liquid cutting jet of the pressurized liquid cutting medium, to be connected with a pressure sensor which constitutes a pressure cell including a membrane-controlled switch. This connection of the gas space with the pressure sensor preferably can be established through an opening in the wall of the jet discharge channel or passage via a suitable pressure transmission line.

In such pressure or reduced pressure sensor which may also be called a pressure monitor, the measuring implement or facility is constituted by a membrane, the response of which can be adjusted to a predetermined reference or set value. When, due to pressure changes, such reference value is reached, for example, by a drop or by a rise in the pressure, as the case may be, a microswitch, which is operatively connected with the membrane, is opened or closed. As a result, a current circuit is also opened or closed for the actuator or control member of the cut-off device or throughflow regulator in the supply system for the pressurized liquid cutting medium or for the control element or switch at the high pressure installation. The switching or response point of the pressure sensor can be varied by means of an adjustment or set screw provided for the pressure sensor.

In this manner commercially available pressure monitors can be adjusted to the momentary cross-sectional area of the jet exit opening, to the momentary pressure of the pressurized liquid cutting medium and to the momentarily used composition of the liquid cutting medium. It has been found that, for example, at a diameter of about 0.3 mm and at a pressure of about 3.5 kilobar of the liquid cutting jet formed by the pressurized liquid cutting medium there appear pressure differences in the order of about 0.06 bar at the pressure or reduced pressure sensor. This pressure difference still amounts to about 0.003 bar, when the liquid cutting jet formed by the pressurized liquid cutting medium has a diameter of about 0.12 mm and a pressure of about 1 kilobar. It has also been found that this pressure difference, relatively independently of the nozzle size, rises very rapidly to values above about 0.1 bar upon the occurrence of even the smallest changes at the nozzle. There is thus ensured an unambiguous and reliably effective control magnitude.

When the cutter head is intended to possess the smallest possible space requirements and even when a commercially available pressure monitor is intended to be employed, it is advantageous to arrange the pressure transmission line or conduit at an angled configuration within the cutter head, for example, within a nozzle retainer of the cutter head. In the most simple case the pressure transmission line or conduit preferably extends first approximately perpendicular to the direction of the liquid cutting jet formed by the pressurized liquid cutting medium and then, while still disposed within the cutter head, the housing of the cutter head or any other suitable member of the cutter head, substantially parallel to such jet direction. This can be of advantage, for example, when the exit end of the cutter head is provided with its own drive means for exactly driving the cutter head along predetermined contours.

It may be further mentioned that there exist practically no limitations as concerns the selection of the type of pressure or reduced pressure sensor and the transmitter as well as the actuator, the cut-off device or the throughflow regulator and the control element.

BRIEF DESCRIPTION OF THE DRAWING

The invention will be better understood and objects other than those set forth above, will become apparent when consideration is given to the following detailed description thereof. Such description makes reference to the annexed single drawing which is a schematic and diagrammatic illustration of a preferred embodiment of the inventive liquid jet cutting apparatus and in which the cutter head is shown on an enlarged scale and in a partially sectional view.

DETAILED DESCRIPTION OF THE PREFERRED EMBODIMENTS

Describing now the drawing, it is to be understood that only enough of the construction of the liquid jet cutting apparatus has been shown as needed for those skilled in the art to readily understand the underlying principles and concepts of the present development, while simplifying the showing of the drawing. Turning attention now specifically to the single FIGURE of the drawing which shows an exemplary embodiment of the inventive liquid jet cutting apparatus, a liquid cutting medium is pressurized to a pressure up to several kilobars by means of a high-pressure installation 8 which, for example, may constitute a high-pressure pump, a pressure intensifier or any other suitable device or means for increasing the pressure of a suitable liquid cutting medium supplied thereto. The pressurized liquid cutting medium is supplied or infed to a cutter head 1 by means of lines or conduits 87 and 71 in which there is connected a cut-off device or throughflow regulator 7 constituting control means for the supply of the liquid cutting medium.

The cutter head 1 can be guided along a desired cutting contour of the material to be cut by means of, for example, program-controlled servomotors; such guide means are of conventional structure and therefore not particularly illustrated, particularly since they are unimportant for the understanding of the teachings of the invention.

The region of a jet exit or outlet opening 13 for a focused cutting jet in the cutter head 1 is illustrated in the single FIGURE of the drawing on an enlarged scale. The highly pressurized liquid cutting medium 2 is fed into the interior space 11 of a housing 10 which is closed downwardly or at a lower side thereof in the manner of a screw cap by means of a retainer 12 which is threadably connected with the housing 10 and which holds a nozzle block 14 which contains the jet exit or outlet opening 13.

A jet discharge channel or passage 15 bounded by a wall 151 of the retainer 12 is formed or arranged downstream of the nozzle block 14 and extends coaxially thereto in this retainer 12. The focused liquid cutting jet 21, which is forced through the jet exit opening 13, does not contact the wall 151 of the jet discharge channel or passage 15 and, as a result, there is left free or defined an annularly shaped gas space 18. An opening 152 is provided in the wall 151 which bounds or defines the jet discharge channel or passage 15. From this opening 152 a transmission or pressure transmission line or conduit 16 extends or branches off from the jet discharge channel or passage 15, preferably at approximately right angles thereto. This transmission or pressure transmission line or conduit 16 then further extends to the outside through a sleeve 17 and thereafter via a preferably flexible guide structure like, for example, a pressure-proof hose 19, and ultimately opens into a pressure or reduced pressure sensor 3 containing a membrane 31 and a pressure threshold value adjustment or set screw 32.

The membrane 31 of the pressure or reduced pressure sensor 3 is operatively connected to a switch which constitutes a transmitter 4. When the preset or predetermined pressure threshold value is reached, for example, when the pressure difference strongly increases due to a variation in the geometry of the cutting jet or when the pressure drops due to a pressure drop or due to a variation in the composition of the pressurized liquid cutting medium, there is cut-in a flow of current in a current circuit 5 including a suitable current source 51. As a result, a supply current is fed to an actuator or control member 6 which, for example, may constitute a servomotor. The actuator or control member 6 controls a cut-off device or throughflow regulator 7 which, for example, may constitute a 3-way valve. As a result of the just-described arrangement the pressurized liquid cutting medium, for example, can be recirculated through a return line 78 indicated by broken lines until the nozzle block 14 has been exchanged or any other remedial or corrective measure has been undertaken to remove the cause of the initial response of the pressure or reduced pressure sensor 3.

There is also indicated in the single FIGURE of the drawing by broken lines, a line 5' which leads to a control element or switch 81 of the high-pressure installation 8. By means of such arrangement the high-pressure installation 8 may be directly cut-off in order to interrupt the cutting jet 21 upon the occurrence of variations therein.

There is furthermore provided and indicated by broken lines in the retainer or holder member 12 of the cutter head 1 an angled or bent course of the transmission or pressure transmission line or conduit 16 which includes a branch 16' extending substantially parallel to the direction of the liquid cutting jet formed by the pressurized liquid cutting medium. Such branching of the pressure or pressure transmission line or conduit 16 may result in facilitating the manipulation of the liquid jet cutting apparatus.

There is further indicated in the single FIGURE of the drawing and in dash-dotted lines, warning means or an alarm 60 which is also connected in the current circuit 5 and which is also activated by the switch or transmitter 4 which is operatively connected to the membrane 31 of the pressure or reduced pressure sensor 3. This warning means or alarm 60, therefore, also responds to undesirable changes in the geometry or other properties of the liquid cutting jet formed by the pressurized liquid cutting medium and thus alerts the operating personnel to such condition. As illustrated in the single FIGURE of the drawing the warning means or alarm 60 is connected parallel to the actuator or control member 6 and the control element or switch 81 acting upon the high-pressure installation 8. Depending on the prevailing conditions, it may be sufficient to provide the inventive liquid jet cutting apparatus only with the warning means or alarm 60 without any automatic control means like the cut-off device or throughflow regulator 7 or the control element or switch 81 which cause an interruption in the supply of the pressurized liquid cutting medium through the supply lines 87 and 71 to the cutter head 1 in the case of irregularities in the liquid cutting jet passing through the jet discharge channel or passage 15. In such case there is merely alerted the operating personnel to such irregularities by the warning means or the alarm 60 and there can thus be initiated the momentarily required countermeasures by the operating personnel.

It has been found that when using the inventive liquid jet cutting apparatus which is of a comparatively simple construction, there can be achieved a high degree of manufacturing reliability and a minimization of waste or reject production.

While there are shown and described present preferred embodiments of the invention, it is to be distinctly understood that the invention is not limited thereto, but may be otherwise variously embodied and practiced within the scope of the following claims.

What I claim is:

1. A liquid jet cutting apparatus comprising:

a high-pressure installation for pressurizing a liquid cutting medium to a predetermined high pressure;

a cutter head;

supply lines connecting said high-pressure installation and said cutter head and supplying said pressurized liquid cutting medium from said high-pressure installation to said cutter head;

said cutter head containing a housing provided with a jet exit opening from which, during a cutting operation, there exits a liquid cutting jet formed by said pressurized liquid cutting medium;

control means for controlling the supply of said pressurized liquid cutting medium to said jet exit opening;

wall means defining a jet discharge passage and a gas space through which flows said liquid cutting jet formed by the pressurized liquid cutting medium;

a pressure sensor connected to said gas space defined by said wall means and provided with means for adjustment of said pressure sensor to a predetermined pressure threshold value;

said pressure sensor being responsive to the pressure prevailing in said gas space defined by said wall means;

a transmitter operatively associated with said pressure sensor;

warning means; and said transmitter operatively associated with said pressure sensor being operatively connected to said warning means and activating said warning means whenever said pressure prevailing in said gas space rises above or drops below said predetermined pressure threshold value to which said pressure sensor is adjusted, in order to thereby indicate an undesirable condition of said liquid cutting jet formed by said pressurized liquid cutting medium.

2. A liquid jet cutting apparatus, comprising:

a high-pressure installation for pressurizing a liquid cutting medium to a predetermined high pressure;

a cutter head;

supply lines connecting said high-pressure installation and said cutter head and supplying said pressurized liquid cutting medium from said high-pressure installation to said cutter head;

said cutter head containing a housing provided with a jet exit opening from which, during a cutting operation, thus exits a liquid cutting jet formed by said pressurized liquid cutting medium;

control means for controlling the supply of said pressurized liquid cutting medium to said jet exit opening;

wall means defining a jet discharge passage and a gas space through which flows said liquid cutting jet formed by said pressurized liquid cutting medium;

a pressure sensor connected to said gas space defined by said wall means and provided with means for adjustment of said pressure sensor to a predetermined pressure threshold value;

said pressure sensor being responsive to the pressure prevailing in said gas space defined by said wall means;

a transmitter operatively associated with said pressure sensor; and said transmitter operatively associated with said pressure sensor being operatively connected to said control means controlling the supply of said pressurized liquid cutting medium to said jet exit opening and acting upon said control means whenever said pressure prevailing in said gas space rises above or drops below said predetermined pressure threshold value to which said pressure sensor is adjusted.

3. The liquid jet cutting apparatus as defined in claim 2, wherein:

said liquid cutting jet formed by said pressurized liquid cutting medium is passed through said jet discharge passage and said gas space defined by said wall means without contacting said wall means and thereby bounds said gas space.

4. The liquid jet cutting apparatus as defined in claim 2, wherein:

said wall means defining said jet discharge passage and said gas space is arranged substantially immediately downstream of said jet exit opening.

5. The liquid jet cutting apparatus as defined in claim 2, further including:

a pressure transmission line interconnecting said gas space and said pressure sensor.

6. The liquid jet cutting apparatus as defined in claim 2, further including:

warning means operatively connected to said transmitter; and said warning means being activated by said transmitter whenever said pressure prevailing in said gas space rises above or drops below said predetermined pressure threshold value to which said pressure sensor is adjusted, in order to thereby indicate an undesirable condition of said liquid cutting jet formed by said pressurized liquid cutting medium.

7. The liquid jet cutting apparatus as defined in claim 2, wherein:

said control means controlling the supply of said pressurized liquid cutting medium to said jet exit opening contain means for cutting-off said supply of said pressurized liquid cutting medium to said jet exit opening.

8. The liquid jet cutting apparatus as defined in claim 2, further including:

a return line connecting said control means and said high-pressure installation; and said control means, when acted upon by said transmitter, being adjusted to conduct the pressurized liquid cutting medium from the return line to the high-pressure installation.

9. The liquid jet cutting apparatus as defined in claim 2, wherein:

said control means controlling the supply of said pressurized liquid cutting medium to said jet exit opening comprises a control element which, when acted upon by said transmitter, cuts off said high-pressure installation.

10. The liquid jet cutting apparatus as defined in claim 4, wherein:

said pressure sensor is arranged in the region of said wall means defining said jet discharge passage and said gas space.

11. The liquid jet cutting apparatus as defined in claim 4, wherein:

said pressure sensor is arranged in said wall means defining said jet discharge passage and said gas space.

12. The liquid jet cutting apparatus as defined in claim 2, wherein:

said wall means defining said jet discharge passage and said gas space comprises an opening;

a conduit connected to said gas space through said opening and extending through said cutter head transversely to a predetermined flow direction defined by said liquid cutting jet formed by said pressurized liquid cutting medium; and said conduit interconnecting said opening and said pressure sensor.

13. The liquid jet cutting apparatus as defined in claim 12, wherein:

said conduit connected to said opening in said wall means extends substantially normally to said predetermined flow direction defined by said liquid cutting jet formed by said pressurized liquid cutting medium.

14. The liquid jet cutting apparatus as defined in claim 5, wherein:

said pressure transmission line constitutes an angled pressure-transmission line extending through said cutter head; and said angled pressure-transmission line including a branch means extending substantially parallel to a predetermined flow direction defined by said liquid cutting jet formed by said pressurized liquid cutting medium.

15. The liquid jet cutting apparatus as defined in claim 14, wherein:

said wall means defining said jet discharge passage and said gas space contains an opening; and said pressure transmission line being connected to said gas space through said opening.

16. The liquid jet cutting apparatus as defined in claim 2, wherein:

said pressure sensor constitutes a pressure cell containing a membrane; and said transmitter operatively associated with said pressure sensor constitutes a switch controlled by said membrane of said pressure cell constituting said pressure sensor.

17. The liquid jet cutting apparatus as defined in claim 16, further including:

a pressure transmission line intercOnnecting said gas space and said pressure cell.

18. The liquid jet cutting apparatus as defined in claim 17, wherein:

said wall means defining said jet discharge passage and said gas space contains an opening; and said pressure transmission line being connected to said gas space through said opening.

19. A liquid jet cutting apparatus comprising:

a high-pressure installation for pressurizing a liquid cutting medium to a predetermined high pressure;

a cutter head;

supply lines connecting said high-pressure installation and said cutter head and supplying said pressurized liquid cutting medium from said high-pressure installation to said cutter head;

said cutter head containing a housing provided with a jet exit opening from which, during a cutting operation, there exits a liquid cutting jet formed by said pressurized liquid cutting medium;

control means for controlling the supply of said pressurized liquid cutting medium to said jet exit opening;

wall means defining a jet discharge passage and a gas space through which flows said liquid cutting jet formed by the pressurized liquid cutting medium;

a pressure sensor connected to said gas space defined by said wall means;

said pressure sensor being responsive to the pressure prevailing in said gas space defined by said wall means;

means for adjustment of a predetermined pressure threshold value and operatively associated with said pressure sensor;

a transmitter operatively associated with said pressure sensor;

warning means; and said transmitter operatively associated with said pressure sensor being operatively connected to said warning means and activating said warning means whenever said pressure prevailing in said gas space rises above or drops below said predetermined pressure threshold value, in order to thereby indicate an undesirable condition of said liquid cutting jet formed by said pressurized liquid cutting medium.

20. A liquid jet cutting apparatus, comprising:

a high-pressure installation for pressurizing a liquid cutting medium to a predetermined high pressure;

a cutter head;

supply lines connecting said high-pressure installation and said cutter head and supplying said pressurized liquid cutting medium from said high-pressure installation to said cutter head;

said cutter head containing a housing provided with a jet exit opening from which, during a cutting operation, thus exits a liquid cutting jet formed by said pressurized liquid cutting medium;

control means for controlling the supply of said pressurized liquid cutting medium to said jet exit opening;

wall means defining a jet discharge passage and a gas space through which flows said liquid cutting jet formed by said pressurized liquid cutting medium;

a pressure sensor connected to said gas space defined by said wall means;

said pressure sensor being responsive to the pressure prevailing in said gas space defined by said wall means;

means for adjustment of a predetermined pressure threshold value and operatively associated with said pressure sensor;

a transmitter operatively associated with said pressure sensor; and said transmitter operatively associated with said pressure sensor being operatively connected to said control means controlling the supply of said pressurized liquid cutting medium to said jet exit opening and acting upon said control means whenever said pressure prevailing in said gas space rises above or drops below said predetermined pressure threshold value.

* * * * *